US006871455B1

(12) United States Patent
Cockman et al.

(10) Patent No.: US 6,871,455 B1
(45) Date of Patent: Mar. 29, 2005

(54) DRIVE/AUGER ANCHOR AND STABILIZER

(76) Inventors: Norman Frank Cockman, 122 Melbourne La., Greenville, SC (US) 29615; Silas E. Winn, 405 Meadow La., Hallsville, MO (US) 65255

( * ) Notice: Subject to any disclaimer, the term of this patent is extended or adjusted under 35 U.S.C. 154(b) by 123 days.

(21) Appl. No.: 10/269,552

(22) Filed: Oct. 10, 2002

(51) Int. Cl.[7] ..... E02D 5/74

(52) U.S. Cl. ..... 52/165; 52/157; 52/298; 52/DIG. 11; 135/118; 248/156; 248/508; 248/522; 248/523; 248/532; 248/545; 256/DIG. 5; 403/164

(58) Field of Search ..... 52/155–157, 298, 52/DIG. 11, 165 O; 248/156, 545, 521, 522, 523, 532, 507, 508; 256/DIG. 5; 403/84, 78, 164; 405/244; 135/118

(56) References Cited

U.S. PATENT DOCUMENTS

| | | | | | |
|---|---|---|---|---|---|
| 204,246 | A | | 5/1878 | Pierce | |
| 279,440 | A | | 6/1883 | Rutz | |
| 3,809,346 | A | | 5/1974 | Jackson | |
| 4,593,872 | A | * | 6/1986 | Svensson | 248/156 |
| 4,863,137 | A | * | 9/1989 | Cockman et al. | 248/545 |
| 4,923,165 | A | * | 5/1990 | Cockman | 248/545 |
| 5,066,168 | A | * | 11/1991 | Holdeman | 405/249 |
| 5,123,623 | A | | 6/1992 | McNamara | |
| 5,404,682 | A | * | 4/1995 | West | 52/165 |
| 5,649,690 | A | | 7/1997 | Kilmer | |
| 5,884,874 | A | * | 3/1999 | Speece et al. | 248/516 |
| 5,927,677 | A | * | 7/1999 | Speece et al. | 248/516 |
| 6,128,867 | A | | 10/2000 | MacKarvich | |
| 6,272,798 | B1 | | 8/2001 | Cockman | |
| 6,273,390 | B1 | * | 8/2001 | Meyer | 248/507 |
| 6,298,611 | B1 | | 10/2001 | Oliver et al. | |
| 6,334,281 | B1 | | 1/2002 | Oliver et al. | |

* cited by examiner

*Primary Examiner*—Carl D. Friedman
*Assistant Examiner*—Yvonne M. Horton
(74) *Attorney, Agent, or Firm*—McNair Law Firm, P.A.

(57) ABSTRACT

A reinforced ground anchor including a spike, a pressure cap having a planar surface, a rod having a drive section at one end, and a swivel connection connecting said pressure cap with the rod. An opening is formed in the pressure cap. A guide is located adjacent the opening. The pressure cap engages flush with the surface of the ground, due to the action of the swivel connection, when the rod is positioned in the ground soil and the spike passes through the opening to engage in the ground soil at an acute angle. The spike and the cap in combination with the rod provide the anchor with additional resistance against horizontal and vertical pressure.

20 Claims, 3 Drawing Sheets

DRIVE/AUGER ANCHOR AND STABILIZER

BACKGROUND OF THE INVENTION

This instant invention is directed to a reinforced anchor primarily for use with manufactured homes.

There is an ever-increasing effort in the manufactured housing industry to develop anchors capable of retaining position in the force of increased pressure, both horizontal and vertical. Due to disastrous effect of windstorms, tornadoes and hurricanes on manufactured homes, the housing industry now requires that all such homes be anchored in position. It is further required that such anchors withstand 4725 pounds of horizontal force with no more than 3" of lateral movement of the head of the rod. Also, the anchor must withstand 4725 pounds of vertical pressure with no more than 2" of head movement.

It is sometimes difficult to meet these standards particularly in rocky soil where it is difficult to set the anchor at the normal 36". Also, when the soil conditions are subject to drastic changes in consistency between being wet and dry or are excessively sandy the above standards are difficult to meet.

It is an object of the instant invention to provide an anchor, which meets and exceeds the required standards of resistance to force.

It is a further object of the invention to provide an anchor with increased resistance to force when anchored in rocky soil, sandy soil or soil which changes consistency in response to weather conditions.

It is a further object of the invention to provide an anchor which meets the above standards in class 3 soil.

It is a further object of the invention to provide an anchor which functions with an anchor rod, which is no more than 18" in length.

It is another object of the invention to provide an anchor with a plurality of anchoring members.

It is another object of the invention to provide an improved anchor cap.

SUMMARY OF THE INVENTION

The invention is directed to a ground anchor, which secures ground soil with increased holding ability. The anchor includes a spike; a rod having a drive section at one end and a pressure cap having a top surface with a central opening for receiving the drive section of the rod. At least one slot is formed in a planar section of the cap adjacent the central opening for receiving the spike.

A swivel connection connects the pressure cap with the drive section. The swivel connection allows the rod to be embedded in the ground soil at a first angle which is less than vertical while the downward surface of the cap is positioned flush against the surface of the ground and with the spike extending through the slot and embedded in the ground soil at a second angle greater than the angle of the rod. The cap and the spike with the rod provide an increased resistance against vertical and horizontal pressure for the anchor.

The improved anchor is capable of maintaining position against in excess of 4725 pounds of both horizontal and vertical pressure.

There may be two or more slots formed in the pressure cap in generally opposed positions. Also, there is provided a guide located adjacent each opening for directing the spike through the opening and into ground soil at a desired angle of about 45° relative to the surface of the cap. The guide may comprise a pair of fingers arranged in opposed positions and extending away form the surface. The fingers may extend from opposed sides of the top surface of the cap. The fingers may be formed unitary with the material forming the cap or they may be attached to the cap.

The rod may include an auger section and is preferably between 16" and 30" in length. The spike is about 36" in length.

There are preferably two openings formed in the pressure cap on opposite sides of the longitudinal axis of the rod. There is a guide adjacent each of the openings. The guide may comprise a tube arranged over the opening or it may comprise a pair of fingers adjacent the opening directed away from the planar surface along a common plane. The fingers may extend from the lower surface, the upper surface or one from each of the lower and the upper surface of the planar section.

The invention also includes the method of securing an anchor in ground soil which includes the steps of providing a plurality of spikes; providing a rod with a drive head at one end; providing a pressure cap having a planar surface with guide openings therein and securing the pressure cap with the drive head in a manner which allows the pressure cap to swivel relative to the rod. The method further includes the steps of inserting the rod into the ground soil at a desired angle and positioning the lower surface of the pressure cap into flush engagement with the surface of the ground. Finally, the method includes driving the spikes through the openings in the pressure cap into the ground soil at an angle grater than the angle of insertion of the rod. The relative positions of the rod, the pressure cap and the spikes secure the anchor with the ground soil with increased resistance against horizontal and vertical pressure.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
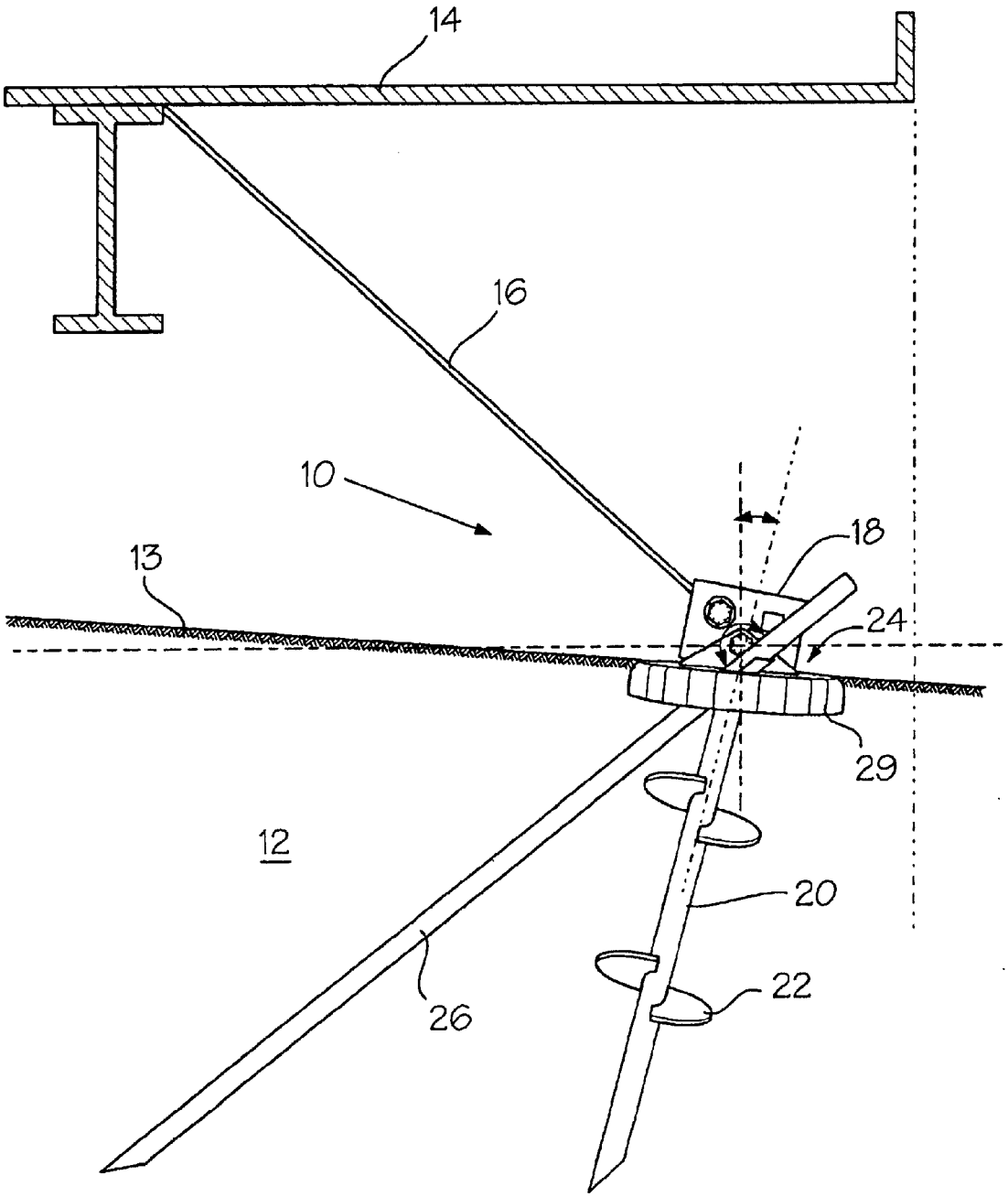
FIG. 1 is a cutaway side view of the anchor in anchoring position and connected with a structure.

FIG. 1 shows anchor 10 secured in ground soil 12 and connected with a structure 14, usually a pre-constructed building, by cable 16. Anchor 10 includes a drive section or drive head 18, rod 20, augers 22, pressure cap 24 and spikes 26.

Figure 2:
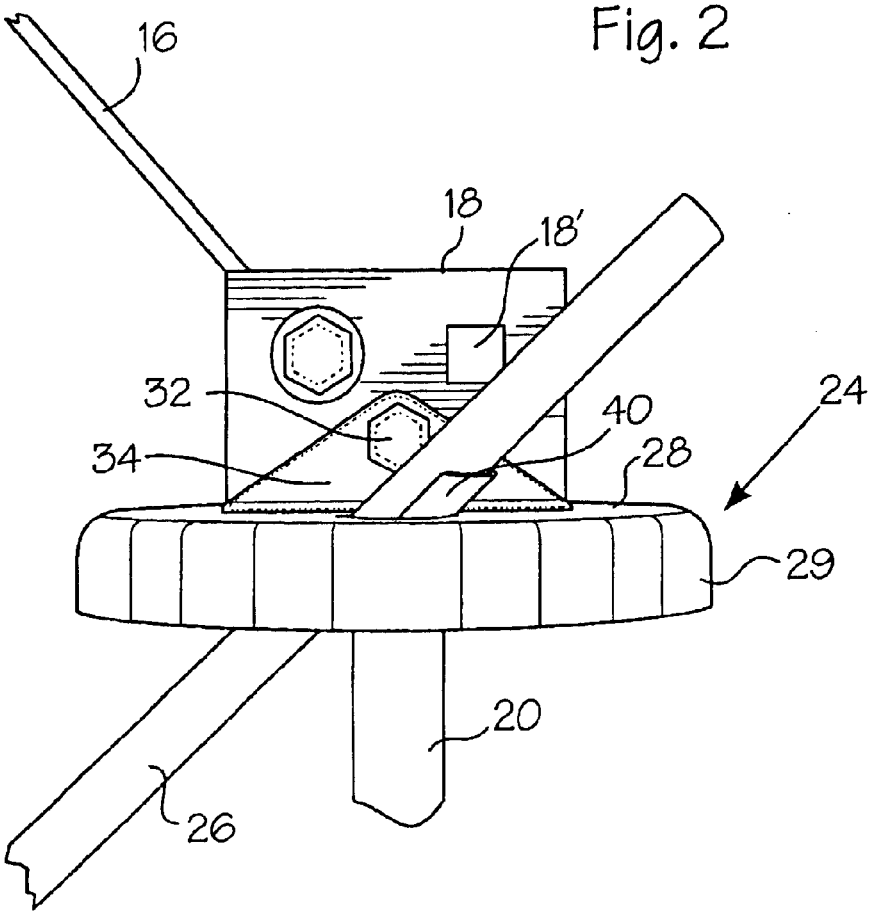
FIG. 2 is a detailed sectional side view of the anchor head.
Figure 3:
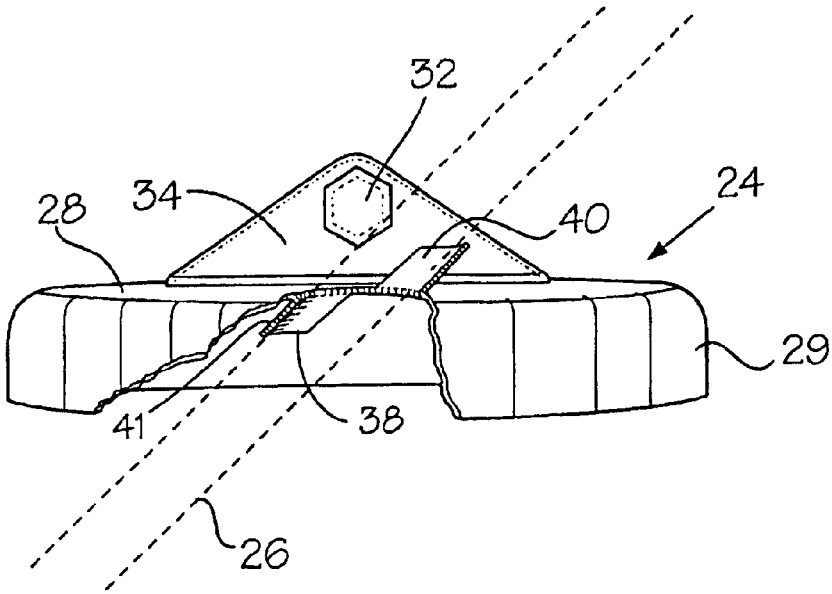
FIG. 3 is a detailed sectional cutaway side view of the pressure cap.
Figure 4:
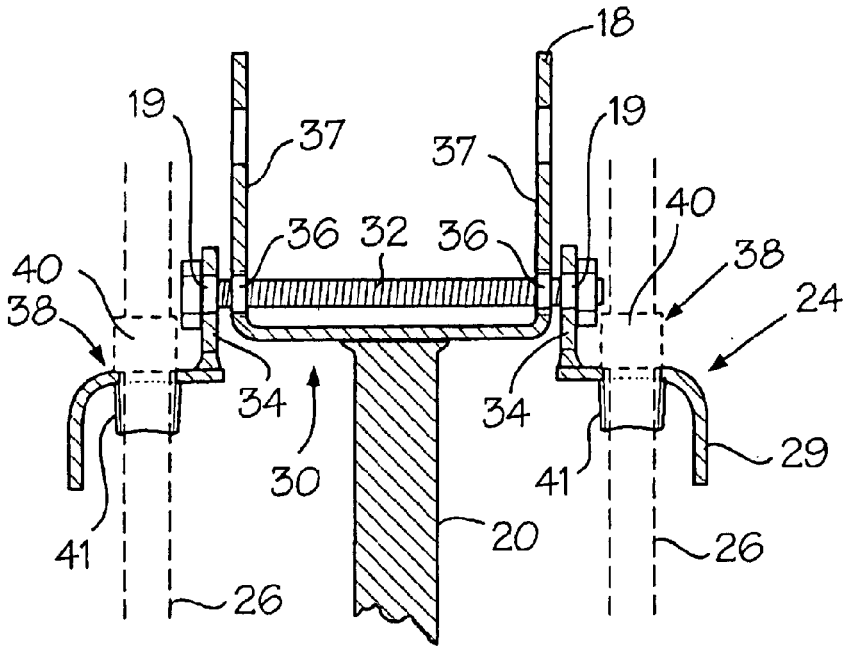
FIG. 4 is a detailed cutaway end view of the pressure cap and drive head.

Turning now also to FIGS. 2 and 3, it can be seen that pressure cap 24 includes a planar area 28 having a down turned rim 29 and a central opening 30. A pair of up turned ears 34 are located in opposed positions adjacent opening 30. Bolt 32 passes through an opening 19 in each ear and also a pair of vertically elongated slots 36 in drive section 18. The connection between the drive head and the pressure cap allow both oscillating and vertical movement for cap 24. The result of this combination of movements creates a swiveling action. This arrangement is more fully discussed in U.S. Pat. No. 6,272,798 to Cockman. The patent also discloses the increased resistance to pressure that a properly seated pressure cap provides.

Figure 5:
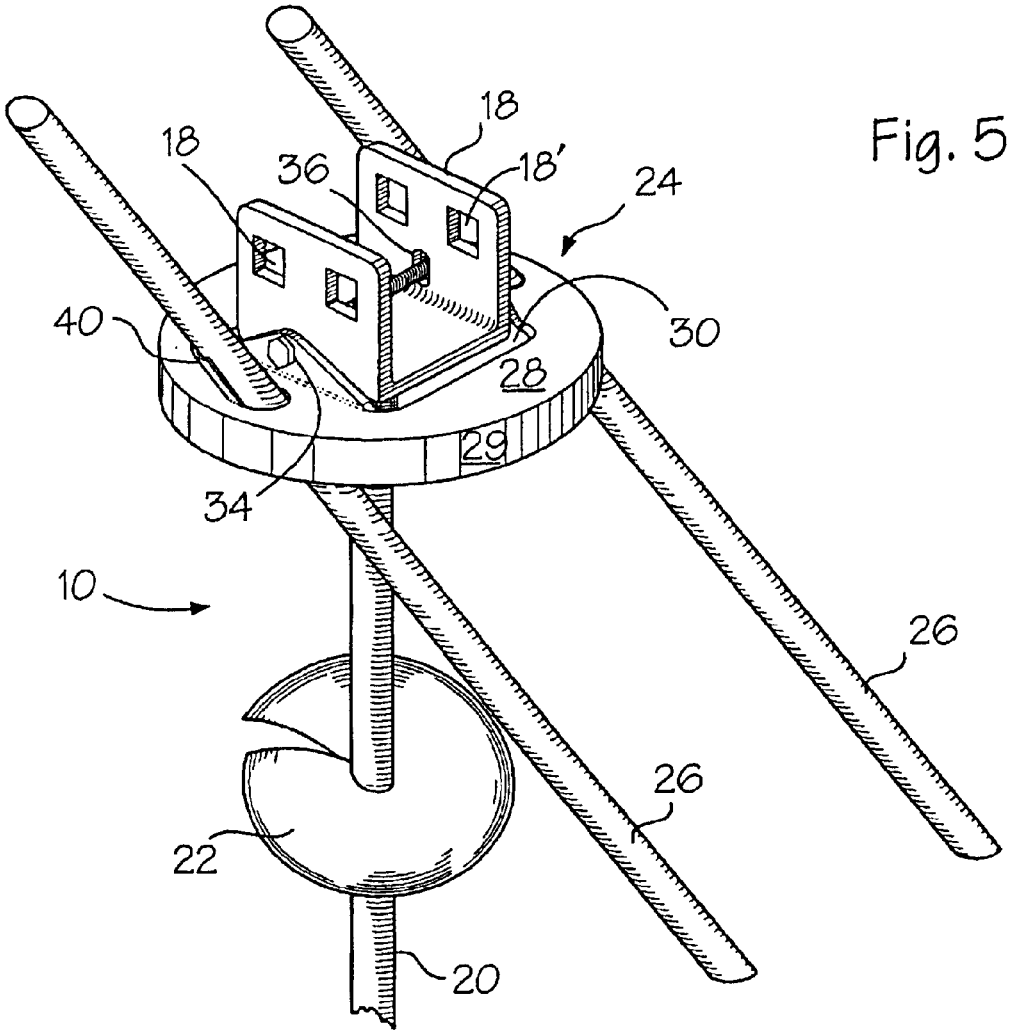
FIG. 5 is a perspective view of the anchor of the invention.

Referring now to the drawings, the invention will now be described in more detail. FIGS. 1 and 5 show best the anchor of the invention.

Primarily the swiveling action of pressure cap 24 allows it to engage evenly and remain so engaged with the surface of the ground while the rod is being bored into the ground soil. This provides for the underside of planar section 28 to be engaged flush with the ground surface when rod 20 is fully embedded in the ground soil 12.

Turning again to FIGS. 2–5 cap 24 is provided with a pair of openings 38 which are arranged in opposed and substantially aligned positions on opposite sides of openings 30. Adjacent to or merging with an edge of each opening 38 is an upwardly extending finger 40. In an opposed position to fingers 40 is a downwardly extending finger 41. Preferably fingers 40, 41 are arranged along opposite sides of a common axis, which is at about 45° to the plane of the planar surface 28 of cap 24. Fingers 40, 41 are designed to receive and guide spikes 26 as they are drilled into the ground surface.

It is noted that openings 19 could comprise vertical slots while slots 36 could be circular openings. Alternately, both could be slots. Also, openings 38 could carry guide tubes secured with the upper or lower surface of planar section 28. There could be as few as one and as many as eight openings 38 arranged about cap 24.

Rod 20 has secured at its upper end with drive section 18. Drive section 18 comprises a U-shaped plate having vertical ears 37.

Rod 20 is generally ¾" in diameter and between 18" and 60" in length. Normally rod 20 is 30" in length, however, it can be around 18" for rocky or hard soil while around 60" is preferred for sandy soil.

Augers 22 are secured along the length of rod 20 and function to screw the rod into the ground soil. The number of augers per rod is optional. In some cases, there may be none and in this instance, the rod is hammered into the ground soil.

Spikes 26 are preferably 36" long and ¾" in diameter. Again depending on soil conditions, the length may vary slightly. In all instances, the length of the spike is greater than the length of the rod.

As shown in FIG. 1, anchor 10, is positioned in the ground soil 12 with rod 20 extending at an acute angle or a slight angle of about 15° from vertical. Pressure cap 24 is positioned with the lower surface of the planar section 28 engaged flush with the ground surface 13 and edge 29 completely buried in the ground soil. This is the ideal position for the rod and pressure cap. Spikes 26 pass through openings 38 are supported in position by fingers 40, 41 and are drilled or hammered into the ground soil along a second angle of about 45°. Spikes 26 act to further stabilize cap 24 with the ground surface. Cable 16 is engaged with building 14 an opening 18' in drive and head or drive section 18.

A primary purpose of the anchor is to provide this resistance to force when soil conditions are less than ideal, i.e. soil rated class 1, 2 or 3. It has been found that the length of rod 20 may be reduced from the normal 30" to be no more than 18" when being installed in rocky or caliche ground soil. Conversely in sandy soil it is desirable that rod 20 be extended to be about 60". Preferably, spikes 26 are about 36" long although this may vary depending on conditions. It is preferred that spikes 26 always be longer than rods 20.

While a preferred embodiment of the invention has been described using specific terms, such description is for illustrative purposes only, and it is to be understood that changes and variations may be made without departing from the spirit or scope of the following claims.

What is claimed is:

1. A ground anchor for securing with ground soil having increased holding ability which includes:

a spike;

a rod having a drive section at one end and a boring section;

a pressure cap having a planar section supporting a down turned rim, said planar section having a central opening receiving said drive section and a slot located between said central opening and said rim for receiving said spike;

a swivel connection connecting said pressure cap with said drive section, whereby;

said anchor is secured in position with said boring section of said rod embedded in said ground soil at a first angle less than vertical, with a downward surface of said planar section of said pressure cap positioned flush against the outer surface of said ground soil and with said spike extending through said slot between said central opening and said rim and embedded in said ground soil at a second angle greater than said first angle, said pressure cap and said spike acting with said rod to provide said anchor with a resistance against vertical and horizontal pressure in excess of 4,725 pounds.

2. The apparatus of claim 1 wherein is no more than 18" in length.

3. The apparatus of claim 1 wherein said slot comprises first and second slots formed in said pressure cap, one on each side of said drive section.

4. The apparatus of claim 1 including a guide connected with said planar section adjacent said slot, said guide directing said spike into said ground soil along a desired angle relative to said planar section of said cap.

5. The apparatus of claim 4 wherein said desired angle is about 45°.

6. The apparatus of claim 4 wherein said guide comprises a pair of fingers formed in opposed positions and extending away from said planar section at a desired angle.

7. The apparatus of claim 6 wherein said fingers extend from opposed sides of said planar section.

8. The apparatus of claim 6 wherein said fingers and said planar section form a unitary piece.

9. A method of securing an anchor in ground soil of varying composition comprising:

providing a plurality of spikes of a first length;

providing a rod of a second and lesser second length having a drive head at one end;

providing a pressure cap having a planar surface with guide openings therein and securing said pressure cap with said drive head in a manner which allows said planar surface of said pressure cap to swivel relative to said rod;

inserting said rod into said ground soil at a desired angle and to a depth in which said pressure cap swivels about said rod positioning said planar surface of said pressure cap into a position in which its lower surface in flush engagement with the surface of said ground soil; and positioning said spikes and guiding said spikes along a selected angle greater than said desired angle while driving said spikes through said openings and into said ground soil whereby, said rod, said pressure cap and said spikes interact to firmly secure said anchor in position in said ground soil.

10. The method of claim 9 including boring said rod into said ground soil.

11. A ground anchor for securing with ground soil having increased holding ability comprising:

a spike;

a pressure cap having a planar surface;

a rod having a drive section at one end;

a swivel connection connecting said pressure cap with said rod;

a guide adjacent an opening formed in said planar surface of said pressure cap for receiving said spike, said guide directing said spike through said pressure cap at an acute angle to said planar section; wherein said planar surface of said pressure cap engages flush with the surface of said ground due to the action of said swivel connection when said rod is positioned in said ground soil and said spike engages in said ground soil through said opening at an acute angle to said planar section, said spike and said cap in combination with said rod providing said anchor with additional resistance against horizontal and vertical pressure.

12. The apparatus of claim 11 wherein said rod is between 16" and 30" in length.

13. The apparatus of claim 11 wherein said spike is about 36" in length.

14. The apparatus of claim 11 wherein said pressure cap includes a down-turned edge about its circumference.

15. The apparatus of claim 11 wherein said opening comprises two openings arranged on opposite sides of the longitudinal axis of said rod.

16. The apparatus of claim 11 wherein said rod includes an auger section.

17. The apparatus of claim 11 wherein said guide comprises a tube arranged over said opening at an angle corresponding with said acute angle.

18. The apparatus of claim 11 wherein said guide comprises a pair of fingers directed away from said planar surface along a common plane.

19. The apparatus of claim 18 wherein one of said fingers extends from the lower surface of said planar section.

20. The apparatus of claim 18 wherein one of said fingers extends from the upper surface of said planar section.

* * * * *